United States Patent [19]

Forster

[11] Patent Number: 5,044,826

[45] Date of Patent: Sep. 3, 1991

[54] METHOD AND APPARATUS FOR UMBILICAL HYDRAULIC CONTROL LINES IN FLOATING PRODUCTION SYSTEMS

[75] Inventor: Larry D. Forster, Houston, Tex.

[73] Assignee: Shell Offshore Inc., Houston, Tex.

[21] Appl. No.: 935,432

[22] Filed: Nov. 26, 1986

[51] Int. Cl.[5] ..... F21B 17/00

[52] U.S. Cl. ..... 405/169; 405/195; 405/170; 166/350; 166/359

[58] Field of Search ..... 405/169, 195, 211, 216, 405/156, 157; 166/338, 339, 344–346, 348, 350, 352, 356, 359, 362, 365, 367

[56] References Cited

U.S. PATENT DOCUMENTS

| | | | |
|---|---|---|---|
| Re. 27,144 | 6/1971 | Rubenstein | 405/157 X |
| 3,250,077 | 5/1966 | Ede | 405/156 |
| 3,313,345 | 4/1967 | Fischer | 166/0.5 |
| 3,352,118 | 11/1967 | Burkhardt | 405/211 |
| 3,368,618 | 2/1968 | Knox | 166/0.5 |
| 3,426,843 | 2/1969 | Visser | 166/0.5 |
| 3,517,110 | 6/1970 | Morgan | 166/350 X |
| 3,563,825 | 2/1971 | Segura et al. | 405/157 X |
| 3,631,933 | 1/1972 | Bryant | 405/156 X |
| 4,068,483 | 1/1978 | Papworth | 405/216 |
| 4,283,161 | 8/1981 | Evans et al. | 405/216 |
| 4,470,722 | 9/1984 | Gregory | 166/350 X |
| 4,527,928 | 7/1985 | Rutherford et al. | 405/195 X |
| 4,643,614 | 2/1987 | Laursen | 166/350 X |

OTHER PUBLICATIONS

Hydril Advanced Ocean Systems catalogue, 1982, pp. 2 and 6.

*Primary Examiner*—Dennis L. Taylor

[57] ABSTRACT

A hydraulic control umbilical is disclosed for supporting a plurality of hydraulic control lines along a riser between a surface facility and a subsea completion. The umbilical provides a skin encircling the riser substantially its entire length with means for supporting the skin about the riser and means for supporting the hydraulic control lines within the skin. A method for deploying and retrieving the hydraulic control umbilical is also disclosed.

37 Claims, 2 Drawing Sheets

FIG. 1
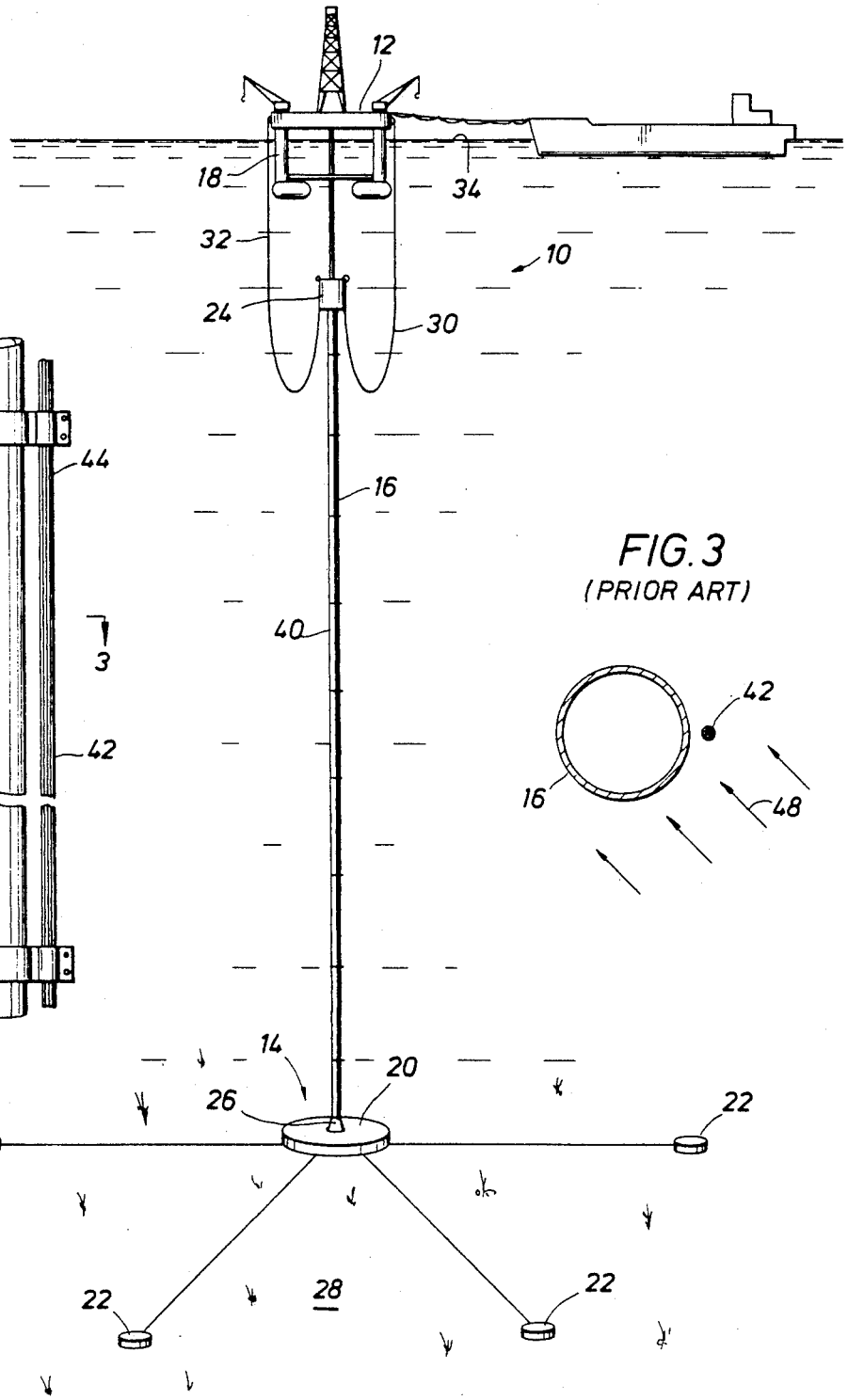
FIG. 2
(PRIOR ART)
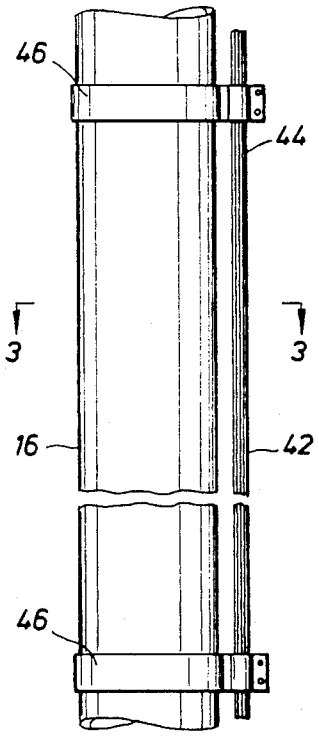
FIG. 3
(PRIOR ART)

FIG.4
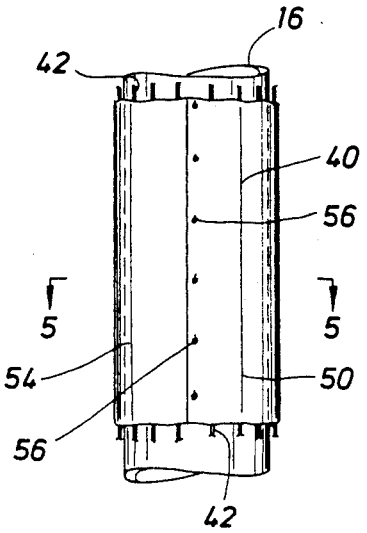
FIG.5
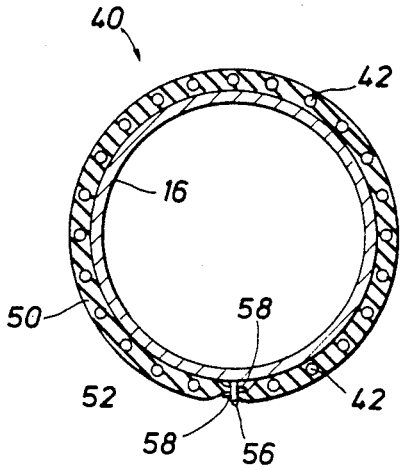
FIG.6
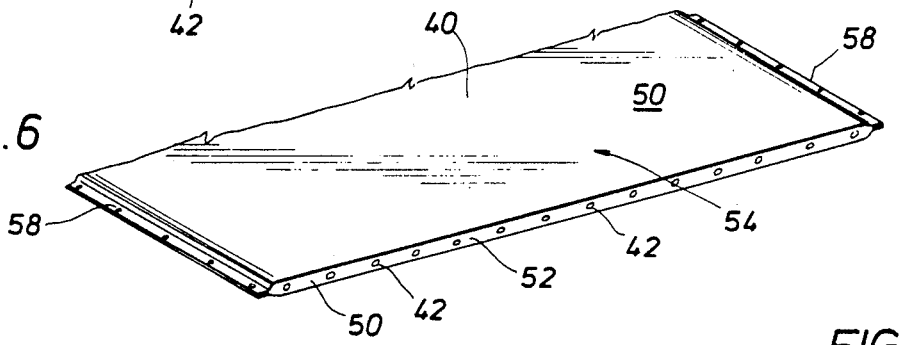
FIG.7
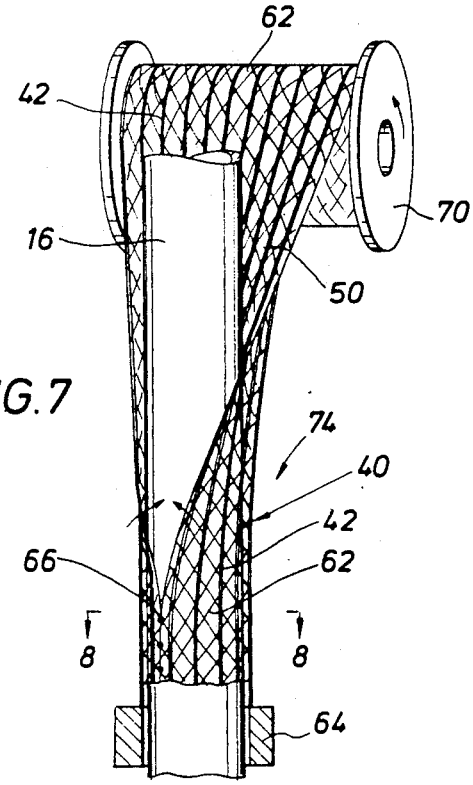
FIG.8
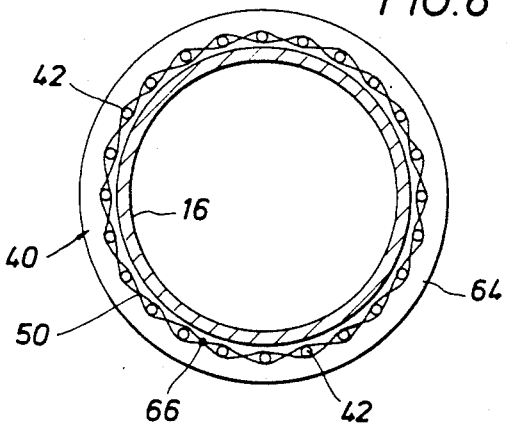
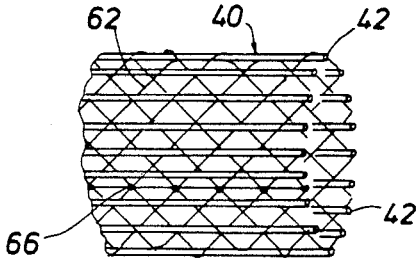
FIG.9

METHOD AND APPARATUS FOR UMBILICAL HYDRAULIC CONTROL LINES IN FLOATING PRODUCTION SYSTEMS

BACKGROUND OF THE INVENTION

This invention relates to a method and apparatus for umbilical control lines from a floating production system and the like, and more particularly, to a method and apparatus for providing hydraulic control lines from floating production systems to subsea completions in high current areas.

Floating production systems utilize subsea completions for economic as well as other advantages in the offshore production of oil and gas. Typically, the subsea completion is coordinated at a template through which several wells have been drilled. The template may also include a number of satellite wells further complicating the necessary control and coordination.

Blowout preventors, subsea trees and other subsea valves and equipment necessary to provide control at the subsea template are most conveniently actuated from the surface facilities with hydraulic control lines. Further, the typical subsea operation of this kind requires a high number of such hydraulic control lines, each extending the length of the production riser which joins the surface facilities to the subsea template. The weight of the hydraulic control lines can be supported with neutral buoyancy, but a problem is presented in providing lateral support and protection to the hydraulic control lines, particularly in high current areas.

SUMMARY OF THE INVENTION

It is an object of the present invention to provide a method and apparatus for supplying hydraulic control lines for floating production systems which is able to withstand the mechanical forces resulting from the action of water currents on the hydraulic control lines and the secondary effects of water currents on a production riser.

It is another object of the present invention to provide a method and apparatus for umbilical hydraulic control lines for floating production systems which is economical in capital cost, operating expenses, maintenance and repair costs over an extended design life.

Another object of the present invention is to provide a method for easily deploying and retrieving umbilical hydraulic control lines for floating production systems.

Toward the fulfillment of these and other objects, a hydraulic control umbilical for supporting a plurality of hydraulic control lines along a riser between a surface facility and a subsea completion which is constructed in accordance with the present invention provides a skin connected to the riser substantially its entire length with means for supporting the skin about the riser and means for supporting the hydraulic control lines within the skin.

The method for deploying the hydraulic control lines for a floating production system in accordance with the present invention provides for supporting the hydraulic control lines within the skin, encircling the riser with the skin substantially the length of the riser and supporting the skin about the riser.

BRIEF DESCRIPTION OF THE DRAWINGS

The brief description above, as well as further objects, features and advantages of the present invention will be more fully appreciated by reference to the following detailed description of the preferred embodiment which should be read in conjunction with the accompanying drawings in which:

FIG. 1 is a side elevation view of a floating production system incorporating a hydraulic control umbilical in accordance with the present invention;

FIG. 2 is a side elevational view of a riser and associated hydraulic control lines in accordance with the prior art;

FIG. 3 is a cross-sectional view of the riser and the hydraulic control lines of the prior art taken at line 3—3 in FIG. 2;

FIG. 4 is a side elevational view of a riser with a hydraulic control umbilical constructed in accordance with the present invention;

FIG. 5 is a cross-sectional view taken at line 5—5 of FIG. 4 of the riser and the hydraulic control umbilical of FIG. 4 constructed in accordance with present invention;

FIG. 6 is a partially broken away perspective view of the hydraulic control umbilical of FIG. 4 constructed in accordance with the present invention;

FIG. 7 is a side elevational view of a riser and a hydraulic control umbilical during deployment in accordance with the present invention;

FIG. 8 is a cross-sectional view taken at line 8—8 of FIG. 7 of the riser and the hydraulic control umbilical of FIG. 7 constructed in accordance with the present invention; and FIG. 9 is a partially broken-away perspective view of the hydraulic control umbilical of FIG. 7 constructed in accordance with the present invention.

DESCRIPTION OF PREFERRED EMBODIMENT

FIG. 1 illustrates offshore production system 10 having surface facilities 12 connected to a subsea completion 14 through a production riser 16. In the illustrated embodiment, surface facilities 12 are provided by a floating platform 18 and connected to a subsea completion 14 at a well template 20 to which satellite wells 22 are connected.

Riser 16 extends from a buoyancy chamber 24 in close proximity to surface facilities 12 to terminate at a riser base 26 which is connected to template 20 at subsea completion 14 on ocean floor 28. Flexible production lines 30 connect the top of riser 16 at buoyancy chamber 24 to surface facilities 12 for accessability at surface 34. Similarly, bundles of hydraulic lines 32 can be conveniently brought to riser 16 at buoyancy chamber 24 from surface facilities 12.

An umbilical 40 of the present invention supports hydraulic control lines 42 [not here illustrated] from the top of riser 16 at buoyancy chamber 24 to the base of the riser at subsea completion 14.

FIGS. 2 and 3 illustrate the prior art in which a bundle 44 of hydraulic lines 42 is secured to riser 16 by clamps 46. The problem of the prior art is intermittent support to hydraulic control lines 42 which leaves unsupported stretches the hydraulic control lines subject to ocean currents. Further, such bundling as is presented in the prior art provides a combined, extended sail area which increases the effect of current load on the hydraulic control lines. This further complicates matters and imposes a serious threat not only to hydraulic control lines 42, but also to riser 16 because the current load on bundle 44 can induce vibrations in bundle 44 between clamps 46 and thereby cause the mass of the bundled hydraulic control lines to beat against the riser. FIG. 3 is a cross-sectional view of riser 16 and bundle 44 at an area of non-support. The ocean current is illustrated with arrows 48.

FIG. 4 is a view of a portion of riser 16 supporting hydraulic control umbilical 40 in which a skin 50 is attached to, and preferably encircling, the riser substantially its entire length. In the embodiments of FIGS. 4 through 6, means for supporting hydraulic control lines 42 is provided by molding the hydraulic control lines, preferably formed of a thermoplastic material, into a flexible, elastomeric matrix 52 to form a ribbon cable umbilical 54. See FIG. 6.

Means for supporting skin 50 about riser 16 is provided in this embodiment by a row of hooks 56 disposed down the length of the riser and a row of eyes 58 disposed along longitudinal edges 60 of ribbon cable umbilical 54, allowing the ribbon cable umbilical to wrap securely around riser 16. See FIG. 5.

Broadly, the method of deploying hydraulic control lines 42 of offshore production system 10 along riser 16 calls for supporting hydraulic control lines 42 within skin 50, encircling riser 16 with the skin substantially the length of the riser and supporting the skin about the riser.

In the hydraulic control umbilical embodiment of FIGS. 4 through 6, hydraulic control lines 42 are supported within the skin by molding the hydraulic control lines longitudinally into a ribbon of a flexible elastomeric matrix and the step of supporting skin 50 about riser 16 is accomplished by fastening eyes 58 along the lateral edges of the skin to hooks 56 for the length of the riser. In the preferred practice of this method, the eyes on the second lateral edge of skin 50 fasten to the same row of closely spaced hooks 56 to which the first edge engaged after the skin is tightly encircled about riser 16. This provides substantially continuous lateral support to the skin as necessary for high current applications.

A remotely operated vehicle (ROV) may be useful to join the hooks and eyes of this embodiment or while operating other means for connecting the lateral edges of ribbon cable umbilical 54 to riser 16 along the length of the riser.

FIGS. 7 through 9 illustrate another embodiment of umbilical 40. FIG. 7 illustrates skin 50 being joined and lowered over riser 16. In this embodiment, skin 50 is an open weave net 62, preferably formed of a flexible plastic matrix and wrapped around riser 16 to form a tubular shaped skin. The lateral edges of net 62 are joined to one another with clips 66, but are not joined to the riser. Hydraulic control lines 42 are run through net 62 which provides means for supporting hydraulic control lines in skin 50. In the preferred embodiment, the hydraulic control lines are neutrally buoyant and need little or no securement to the tubular net in a manner resistant to longitudinal movement because the cross-axial current load against hydraulic control lines 42 is effectively transferred to net 62. Net 62 with installed hydraulic control lines 42 is of sufficient diameter to easily slide down riser 16. However, because of the open weave nature of net 62, the sail area of this umbilical embodiment is so minimal that there may be some slack in the contact of net 62 about riser 16 without substantially increasing the current load on the umbilical. See also FIG. 9 illustrating net 62 with hydraulic control lines 42 in place.

Returning to FIGS. 7 and 8, a neutrally buoyant ring shaped termination fixture 64 at the lower edge of tubular net 62 aids in deployment and retrieval of umbilical 40 about riser 16 and the top of umbilical 40 is secured to the top of riser 16 or buoyancy chamber 24 by conventional means (not shown) thereby providing means for supporting skin 50 about the riser. See also FIG. 1.

In the hydraulic control umbilical embodiment of FIGS. 7 through 9, hydraulic control lines 42 are supported within skin 50 by weaving them in and out of net 62. Although net 62 may be woven into a tubular shape, it is more convenient for deployment if net 62 is flat, forming its tubular shape during deployment about riser 16. In the latter case, encircling riser 16 is accomplished by feeding umbilical 40 off of a spool or drum 70 (illustrated schematically in FIG. 7), wrapping the skin about the riser and bringing the lateral edges of the skin adjacent each other. Encircling the riser continues with the joining of the lateral edges by some suitable means illustrated here by clips 66. The step of joining the edges continues at the top of the riser as the skin feeds off drum 70 and the joined tube 74 advances down riser 16. It is preferred to attach ring-shaped termination fixture 64 to the bottom of net 62 to aid deployment. Umbilical 40 is preferably supported by attaching it to buoyancy chamber 24 (see FIG. 1).

The preferred method of deployment for this embodiment permits most deployment operations for the skin and hydraulic control lines to be conveniently performed in shallow water, immediately beneath the buoyancy chamber 24. Thus, divers can easily aid in setting clips 66 or controlling other means for joining the lateral edges of skin 50. The lower ends of the hydraulic control lines may be joined to the subsea completion in a conventional manner but it may prove convenient to coordinate this connection through termination fixture 64.

Retrieval of the hydraulic control umbilical of FIGS. 7 through 9 essentially reverses the deployment procedure. Hydraulic lines are released from the subsea completion and joined tube 74 is opened at the top of hydraulic control umbilical 40. The top of the hydraulic control umbilical is connected to the drum which is then rotated thereby sliding the hydraulic control umbilical up the riser while opening of the tube at the top of the riser advances and the hydraulic control umbilical is retrieved on the drum.

Another preferred feature of the embodiment of FIGS. 7 through 9 is the ease with which individual hydraulic control lines 42 can be threaded into open weave net 62 or removed therefrom.

The hydraulic control umbilical of the present invention secures the hydraulic control lines to the riser in a manner that provides support against currents substantially the length of the riser. Each of the preferred embodiments of the disclosed umbilical is capable of economically supporting a large number of hydraulic control lines extending from surface facilities to subsea completions. Further, the umbilicals of the present invention are easily deployed and retrieved by methods disclosed above.

Other modifications, changes and substitutions are intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. A hydraulic control umbilical for supporting a plurality of hydraulic control lines along a riser between a surface facility and a subsea completion, the umbilical comprising:

a flexible skin exteriorly encircling the riser and extending substantially the length of the riser;

means for providing lateral support to the skin substantially the length of the riser; and means for supporting the hydraulic control lines within the skin.

2. A hydraulic control umbilical in accordance with claim 1 wherein the skin is neutrally buoyant.

3. A hydraulic control umbilical in accordance with claim 2 wherein the skin is a flexible matrix arranged in a substantially open weave net.

4. A hydraulic control umbilical constructed in accordance with claim 3 wherein means for supporting the hydraulic control lines in the skin is provided by weaving the hydraulic control lines longitudinally through the open weave net.

5. A hydraulic control umbilical constructed in accordance with claim 3 wherein the substantially open weave net is made of plastic.

6. A hydraulic control umbilical constructed in accordance with claim 3 wherein the open weave net is tubular in shape having a diameter sufficient to encircle the riser and wherein the means for supporting the skin about the riser comprises:

means for attaching a first end of the open weave net about a circumference of the riser substantially at the upper end of the riser; and a termination fixture attached to the other end of the open weave net.

7. A hydraulic control umbilical constructed in accordance with claim 6 wherein the termination fixture is a neutrally buoyant ring surrounding the riser.

8. A hydraulic control umbilical constructed in accordance with claim 6 further comprising means for joining the lateral edges of the open weave net to form its tubular shape.

9. A hydraulic control umbilical constructed in accordance with claim 1 wherein the skin is an elongated ribbon.

10. A hydraulic control umbilical constructed in accordance with claim 9 wherein means for supporting the skin about the riser includes means for connecting the longitudinal edges of the ribbon to the riser substantially the entire length of the riser.

11. A hydraulic control umbilical constructed in accordance with claim 10 wherein the width of the ribbon is substantially equal to the circumference of the riser and wherein means for connecting the longitudinal edges of the ribbon to the riser comprises:

a single row of hooks aligned along the length of the riser; and a plurality of eyes disposed along the length of both longitudinal edges of the ribbon.

12. A hydraulic control umbilical constructed in accordance with claim 9 wherein the hydraulic control lines are molded into the ribbon as means for supporting the hydraulic control lines within the skin.

13. A hydraulic control umbilical constructed in accordance with claim 9 wherein the ribbon is made from a flexible elastomeric matrix and the hydraulic lines are thermoplastic hoses.

14. A hydraulic control umbilical for supporting a plurality of hydraulic control lines along a riser between a surface facility and a subsea completion, the umbilical comprising:

a neutrally buoyant substantially open weave net forming a tubular shaped skin encircling the riser substantially its entire length and receiving the hydraulic lines in a weaving relation longitudinally through the open weave net;

means for attaching a first end of the skin about a circumference of the riser substantially at the top end of the riser; and a termination fixture attached to the other end of the skin.

15. A hydraulic control umbilical for supporting a plurality of hydraulic control lines along a riser between a surface facility and a subsea completion, the umbilical comprising:

a neutrally buoyant, elongated ribbon molded about the hydraulic control lines which extend longitudinally therethrough and having a width substantially equal to the circumference of the riser and a length substantially equal to the length of the riser; and means for connecting the longitudinal edges of the ribbon to the riser substantially the entire length of the riser.

16. A method for deploying a plurality of hydraulic control lines along a riser between a surface facility and a subsea completion, the method comprising:

supporting the hydraulic lines within a skin;

encircling the riser with the skin substantially the entire length of the riser; and supporting the skin about the riser.

17. A method for deploying hydraulic control lines in accordance with claim 16 wherein supporting the hydraulic lines within the skin comprises molding the hydraulic control lines longitudinally into a ribbon of a flexible elastomeric matrix.

18. A method for deploying hydraulic control lines in accordance with claim 17 wherein the step of supporting the skin about the riser comprises fastening eyes on both lateral edges of the skin to a plurality of hooks carried along the length of the riser.

19. A method for deploying hydraulic control lines in accordance with claim 18 wherein means for supporting the skin about the riser comprises:

fastening a plurality of eyes on one lateral edge of the skin to a row of hooks extending the length of the riser; and fastening a plurality of eyes on the other lateral edge of the skin to the row of hooks following the step of encircling the with the skin.

20. A method for deploying a plurality of hydraulic control lines in accordance with claim 16 wherein the step of supporting the hydraulic control lines within a skin comprises weaving the hydraulic control lines through a net.

21. A method for deploying a plurality of hydraulic control lines in accordance with claim 16 wherein encircling the riser with the skin comprises:

feeding the skin off a drum;

wrapping the skin about the circumference of the riser and bringing the lateral edges of the skin adjacent each other;

joining the adjacent lateral edges of the skin to form a tube; and advancing the tube down the riser as the adjacent lateral edges of the skin are joined.

22. A method for deploying a plurality of hydraulic control lines in accordance with claim 21 wherein supporting the skin about the riser includes attaching the top of the skin to a buoyancy chamber at the top of the riser.

23. A method for deploying a plurality of hydraulic control lines in accordance with claim 21 further comprising attaching the bottom of the skin to a ring-shaped termination fixture slidably mounted about the riser.

24. A method for retrieving a hydraulic control umbilical having a plurality of hydraulic control lines from a riser extending between a surface facility and a subsea completion, the method comprising:

disconnecting the plurality of hydraulic control lines from the subsea completion;

opening a top of a tube formed by the hydraulic control umbilical in place wrapped about a riser;

connecting the top of the hydraulic control umbilical to a drum after opening the top of the tube;

rotating the drum which is connected to the top of the hydraulic control umbilical; and sliding the hydraulic control umbilical having the disconnected hydraulic control lines up the riser while progressively opening the tube at the top of the riser and retrieving the hydraulic control umbilical on the rotating drum.

25. A method for deploying a hydraulic control umbilical comprising:

encircling a riser of a subsea completion substantially the entire length of the riser with a flexible skin having a plurality of hydraulic lines supported therein; and supporting the skin about the riser.

26. A hydraulic control umbilical for supporting a plurality of hydraulic control lines along a riser between a surface facility and a subsea completion, the umbilical comprising:

a skin formed by a flexible matrix arranged in a substantially open weave net, said skin positioned exterior to the riser and extending substantially the length of the riser;

means for providing lateral support to the skin substantially the length of the riser; and means for supporting the hydraulic control lines within the skin.

27. A hydraulic control umbilical in accordance with claim 26 wherein the skin encircles the riser.

28. A hydraulic control umbilical in accordance with claim 26 wherein the skin is neutrally buoyant.

29. A hydraulic control umbilical constructed in accordance with claim 26 wherein means for supporting the hydraulic control lines in the skin is provided by weaving the hydraulic control lines longitudinally through the open weave net.

30. A hydraulic control umbilical constructed in accordance with claim 26 wherein the substantially open weave net is made of plastic.

31. A hydraulic control umbilical constructed in accordance with claim 26 wherein the open weave net is tubular in shape having a diameter sufficient to encircle the riser and wherein the means for supporting the skin about the riser comprises:

means for attaching a first end of the open weave net about a circumference of the riser substantially at the upper end of the riser; and a termination fixture attached to the other end of the open weave net.

32. A hydraulic control umbilical constructed in accordance with claim 31 wherein the termination fixture is a neutrally buoyant ring surrounding the riser.

33. A hydraulic control umbilical constructed in accordance with claim 31 further comprising means for joining the lateral edges of the open weave net to form its tubular shape.

34. A method for deploying a plurality of hydraulic control lines along a riser between a surface facility and a subsea completion, the method comprising:

supporting the hydraulic lines within a skin by weaving the hydraulic control line through a net;

encircling the riser with the skin substantially the entire length of the riser; and supporting the skin about the riser.

35. A method for deploying a plurality of hydraulic control lines in accordance with claim 34 wherein encircling the riser with the skin comprises:

feeding the skin off a drum;

wrapping the skin about the circumference of the riser and bringing the lateral edges of the skin adjacent each other;

joining the adjacent lateral edges of the skin to form a tube; and advancing the tube down the riser as the adjacent lateral edges of the skin are joined.

36. A method for deploying a plurality of hydraulic control lines in accordance with claim 35 wherein supporting the skin about the riser includes attaching the top of the skin to a buoyancy chamber at the top of the riser.

37. A method for deploying a plurality of hydraulic control lines in accordance with claim 35 further comprising attaching the bottom of the skin to a ring-shaped termination fixture slidably mounted about the riser.

* * * * *